US009240292B1

(12) United States Patent
Lapetina

(10) Patent No.: US 9,240,292 B1
(45) Date of Patent: Jan. 19, 2016

(54) ENVIRONMENTALLY SEALED BUTTON

(71) Applicant: Google Inc., Mountain View, CA (US)

(72) Inventor: John Lapetina, San Francisco, CA (US)

(73) Assignee: Google Inc., Mountain View, CA (US)

( * ) Notice: Subject to any disclaimer, the term of this patent is extended or adjusted under 35 U.S.C. 154(b) by 264 days.

(21) Appl. No.: 13/862,687

(22) Filed: Apr. 15, 2013

(51) Int. Cl.
*H01H 9/04* (2006.01)
*H01H 13/06* (2006.01)

(52) U.S. Cl.
CPC ..... *H01H 9/04* (2013.01)

(58) Field of Classification Search
CPC ..... H01H 23/04; H01H 23/065; H01H 23/06; H01H 13/063; H01H 9/042
USPC ..... 200/302.1–302.3, 341
See application file for complete search history.

(56) References Cited

U.S. PATENT DOCUMENTS

| | | | | |
|---|---|---|---|---|
| 3,950,627 | A | 4/1976 | Murata et al. | |
| 6,377,246 | B1 | 4/2002 | Wild | |
| 6,437,267 | B1 | 8/2002 | Imai | |
| 6,626,473 | B1 * | 9/2003 | Klein et al. | 200/302.2 |
| 6,705,783 | B1 | 3/2004 | Bowen | |
| 2006/0065514 | A1 * | 3/2006 | Toyama | 200/310 |
| 2008/0302641 | A1 * | 12/2008 | Su | 200/302.3 |
| 2012/0111706 | A1 | 5/2012 | Seckel et al. | |

* cited by examiner

*Primary Examiner* — Amy Cohen Johnson
*Assistant Examiner* — Marina Fishman
(74) *Attorney, Agent, or Firm* — Lerner, David, Littenberg, Krumholz & Mentlik, LLP

(57) ABSTRACT

The disclosure relates to a button assembly for a device, such as an electronic device. The button assembly may include a button and a seal. The button may fit within a space defined by the seal. A portion of each of three sealing surfaces may each seal and press against respective surfaces of the button.

20 Claims, 4 Drawing Sheets

ENVIRONMENTALLY SEALED BUTTON

BACKGROUND

Certain devices of the prior art, such as certain electronic devices, include push buttons. Such push buttons, however, allow for debris, such as a dust, dirt, or liquids, to enter into the interior of the device. This is undesirable, as such debris can collect inside the device and can even cause a malfunction of the device.

BRIEF SUMMARY

The disclosure relates to a button assembly for a device, such as an electronic device. The button assembly may include a button and a seal. The button may fit within a space defined by the seal. A portion of each of three sealing surfaces may each seal and press against respective surfaces of the button.

One aspect of the disclosure provides a device, including: a housing; a button disposed at least partially within the housing, the button including: a button surface; a lateral button surface having a width; a flange including an upper flange surface and a lateral flange surface, the lateral flange surface having a width greater than the width of the lateral button surface; a seal disposed at least partially within the housing, the seal including: a first sealing surface, a portion of which contacts the lateral button surface; a second sealing surface, a portion of which contacts the upper flange surface; and a third sealing surface, a portion of which contacts the lateral flange surface.

In one example, the upper flange surface and the lateral flange surface join by a chamfered edge.

In one example, the first sealing surface and the second sealing surface join by a chamfered edge.

In one example, a portion of the upper flange surface is substantially coplanar with a portion of the button surface.

In one example, a portion of the second sealing surface is substantially coplanar with a portion of the upper flange surface.

In one example, the seal further includes an upper sealing surface that contacts a portion of the housing.

In one example, the upper sealing surface includes a first upper sealing surface and a second upper sealing surface, the second upper sealing surface being arranged at a different height with respect to the first upper sealing surface.

In one example, the button surface extends beyond the housing.

In one example, the button includes a tab, the tab being an extension of the flange.

In one example, the seal includes a plurality of protrusions which define a recess therebetween adapted to receive the tab.

In one example, the lateral button surface is substantially cylindrical and the width of the lateral button surface is a radius, and wherein the lateral flange surface forms a portion of an arc of a circle and the width of the lateral flange surface is a radius.

Another aspect of the disclosure provides a button assembly, including: a button including: a button surface; a lateral button surface having a radius; a flange including an upper flange surface and a lateral flange surface, the lateral flange surface having a width greater than the width of the lateral button surface; a seal including: a first sealing surface, a portion of which contacts the lateral button surface; a second sealing surface, a portion of which contacts the upper flange surface; and a third sealing surface, a portion of which contacts the lateral flange surface.

In one example, the upper flange surface and the lateral flange surface join by a chamfered edge.

In one example, the first sealing surface and the second sealing surface join by a chamfered edge.

In one example, a portion of the upper flange surface is substantially coplanar with a portion of the button surface.

In one example, a portion of the second sealing surface is substantially coplanar with a portion of the upper flange surface.

In one example, the upper sealing surface includes a first upper sealing surface and a second upper sealing surface, the second upper sealing surface being arranged at a different height with respect to the first upper sealing surface.

In one example, the button includes a tab, the tab being an extension of the flange.

In one example, the seal includes a plurality of protrusions which define a recess therebetween adapted to receive the tab.

In one example, the lateral button surface is substantially cylindrical and the width of the lateral button surface is a radius, and wherein the lateral flange surface forms a portion of an arc of a circle and the width of the lateral flange surface is a radius.

Another aspect of the disclosure provides a device, including: a housing including an outer housing surface and an inner housing surface; a button disposed at least partially within the housing, the button including: a button surface; a lateral button surface having a radius; a flange including an upper flange surface and a lateral flange surface, the lateral flange surface having a width greater than the width of the lateral button surface; a seal disposed at least partially within the housing, the seal including: a first sealing surface, a portion of which contacts the lateral button surface; a second sealing surface, a portion of which contacts the upper flange surface; a third sealing surface, a portion of which contacts the lateral flange surface; and an upper sealing surface, a portion of which contacts the inner housing surface.

In one example, the upper sealing surface includes a first upper sealing surface and a second upper sealing surface, the second upper sealing surface being arranged at a different height with respect to the first upper sealing surface.

DETAILED DESCRIPTION

Figure 1A:
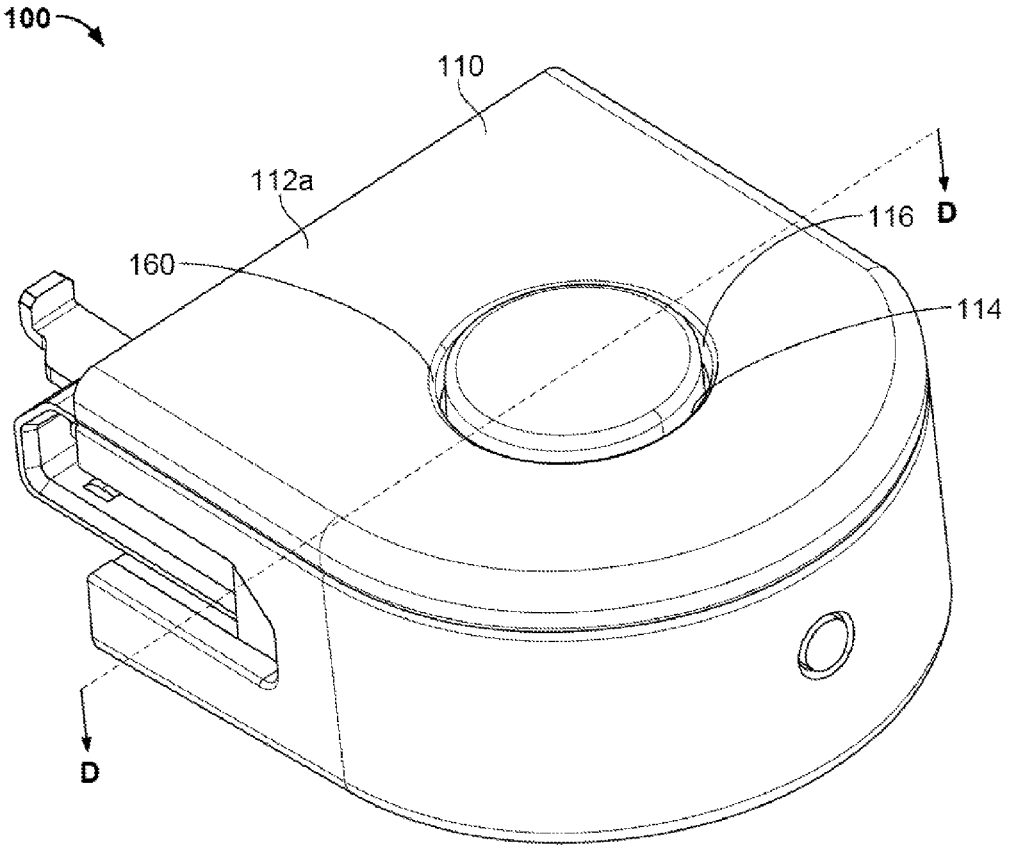
FIG. 1A is partial view of a device according to aspects of the disclosure.
Figure 1B:
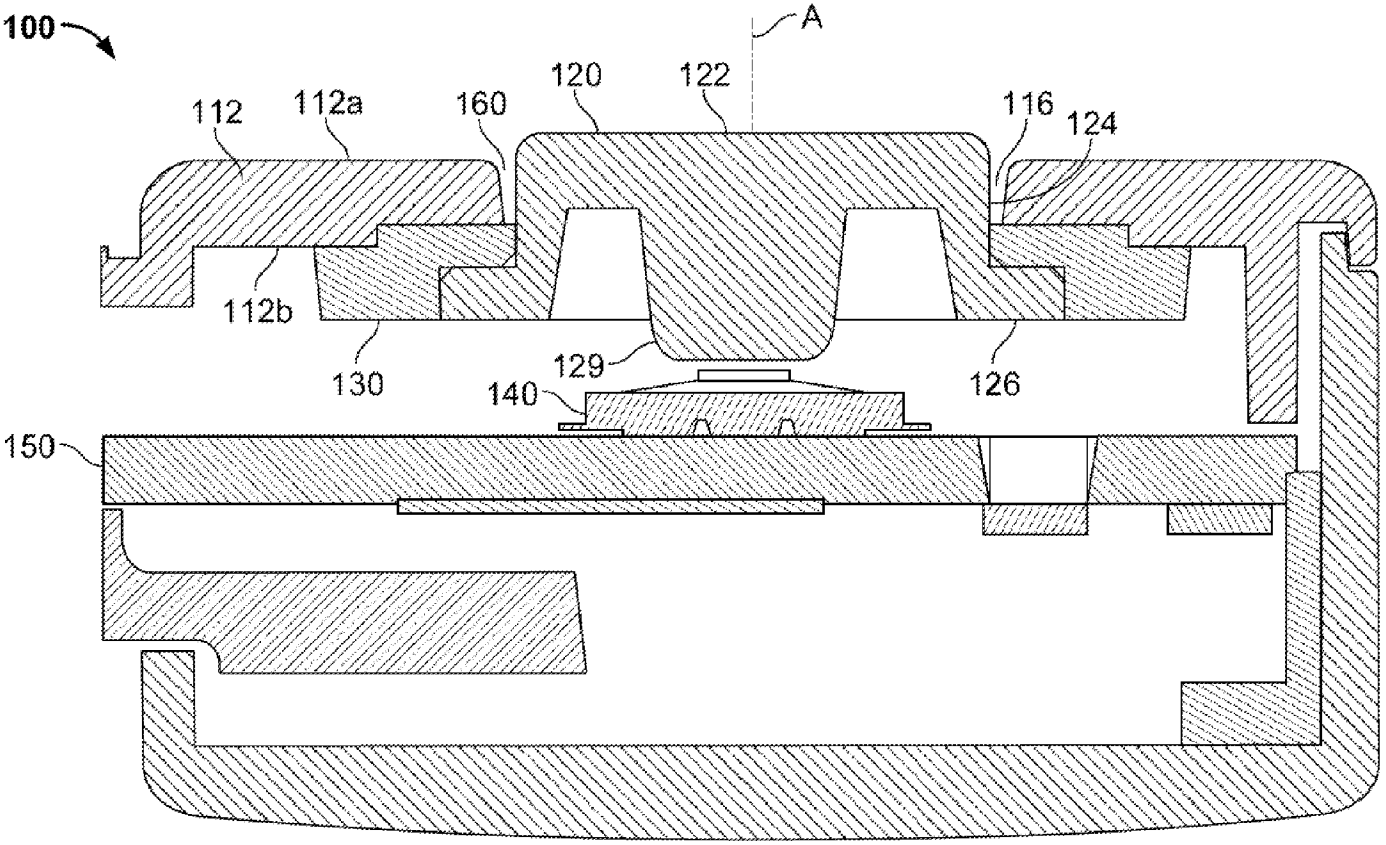
FIG. 1B is a cross-sectional view of the device of FIG. 1A.

FIG. 1A is a partial view of a device 100 according to aspects of the disclosure. FIG. 1B is a cross sectional view of the device 100 shown in FIG. 1A along the line D-D. The device 100 may be any type of electronic device, such as a smart phone, mobile device, tablet, heads up display, head-mountable display, wearable display device, computer, laptop, personal computer, etc. In one example, the device 100 may be a subcomponent of or attachment to any of the above examples. According to aspects of the disclosure, the device may include one or more electronic components or modules (not shown), such as a processor, memory, or the like.

The device 100 may include a housing 110. The housing 110 may be any type of material, such as a plastic, metal, or some combination thereof. The housing 110 may also include an outer housing surface 112*a* which may form at least a portion of an exterior of the device 100. The outer housing surface 112*a* may be any type of shape, depending on the type of device 100. The housing 112 may also include an inner housing surface 112*b*. The inner housing surface 112*b* may be a surface opposed to the outer housing surface 112*a*. The housing 110 may at least partially enclose or encapsulate one or more electronic components of the device 100, as will be described in greater detail below. In this regard, one or more of the internal components may be positioned adjacent, or affixed to, the inner housing surface 112*b*. In some examples the housing 110 may have openings or outlets that may provide access to the components inside. Such openings or outlets, for example, may include a power port, a data port, a vent, or the like. Such openings may be permanently open or semi-permanently open, while in other examples may be capable of being closed and reopened.

The housing 110 may define an aperture 114 for receiving a portion of a button 120. The aperture 114 may be defined, at least in part, by a sidewall 116. The sidewall 116 may be any shape, such as cylindrical, frustoconical, or the like. The sidewall 116 may also be a complex or irregular shapes, such as a combination of the above examples with a polygon. The sidewall 116 may serve to join the outer housing surface 112*a* and the inner housing surface 112*b*.

Other components may be stored within the housing 110, such as a switch 140 and a printed circuit board 150. The switch 140 and printed circuit board 150 may interact with a member 129 of the button 120 to allow pressing or otherwise activating the button 120 to be received by and/or processed by the device 100.

Figure 2:
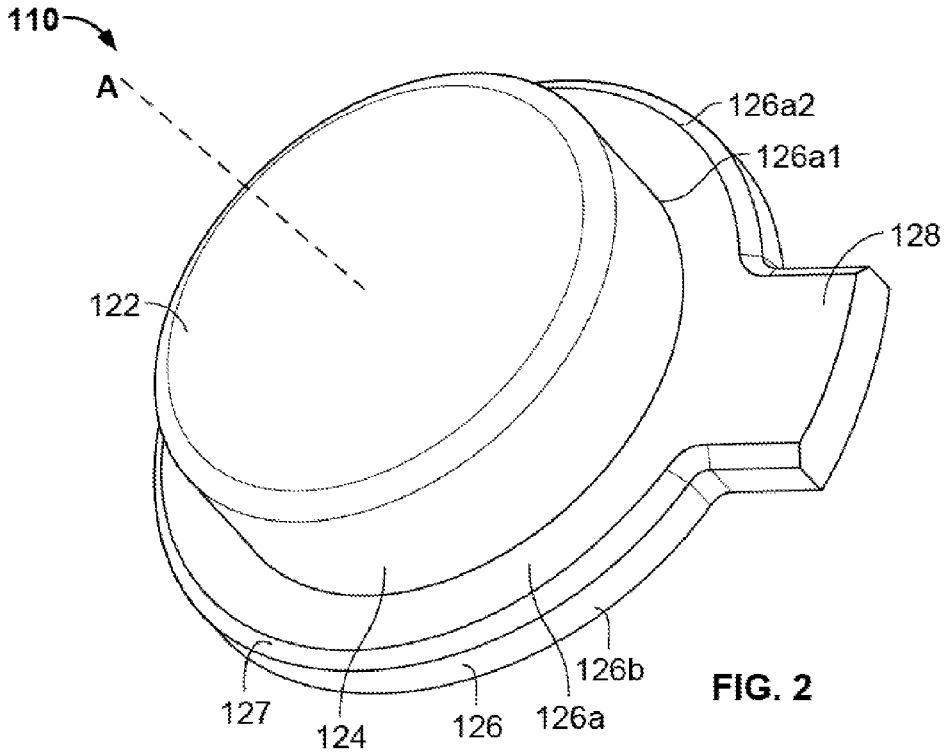
FIG. 2 is a perspective view of a button.

FIG. 2 is a perspective view of the button 120 of the device 100. The button 120 may disposed at least partially in the aperture 114 defined by the sidewall 116, and may be at least partially disposed within the housing 110. In this regard, a portion of the button 120 may be disposed within the housing 110, while another portion of the button 120 may extend beyond and outside of the housing 110. The button 120 may be a push button that, when depressed, pushed, or touched by a user, may cause the device 100 to power up or power down. In other examples, the button 120 may cause the device 110 to perform other functions, such as enter standby mode, take a picture, send a message, enter alphanumeric input, etc.

The button 120 may have a button surface 122. The button surface 122 may be any shape. For example, the button surface may be circular, elliptical, rectangular, or any other type of shape. In one example, at least a portion of the button surface 122 may be substantially flat. In this regard, the portion of the button surface 122 that is substantially flat may itself be coplanar with respect to a portion of the housing 110. In other examples, the button surface 122 may be convex, concave, or any other shape. The button surface 122 may define an axis A that is perpendicular to and passes through at least a portion of the button surface 122. For example, where the button surface 122 is substantially flat, the axis A may be perpendicular to the button surface 122. In other examples, the button surface 122 may have other shapes, as described above, such as convex, concave, or other complex shapes. In these examples, the axis A may be perpendicular to a plane defined by the outer circumference of the button surface 122. The button surface 122 may also include any type of indicia thereon to identify a function associated with pressing the button. For example, the button surface 122 may include indicia to identify the button 120 as a power button. The button surface 122 may also extend above the housing surface 112*a* of the housing 110. In other examples, the button surface 122 may be flush with respect to the outer housing surface 112*a*, or may be recessed with respect to the outer housing surface 112*a*.

The button 120 may have a lateral button surface 124. The lateral button surface 124 may join the button surface 122 at a rounded corner, or at an angled corner. The lateral button surface may be cylindrical, frustoconical, or any other shape, such as any of the shapes described above with respect to button surface 122. As shown in FIG. 1B, a portion of a cross section of the lateral button surface 124 may be perpendicular to the button surface 122. The lateral button surface 124 may have a width. Where the lateral button surface 124 is cylindrical, the width may be a diameter with respect to the axis A. In other examples, such as where the lateral button surface 124 is another shape, the width may be any measurement between opposing surfaces of the lateral button surface 124.

A gap 160 may be formed between a portion of the lateral button surface 124 and the sidewall 116 of the housing 110. The gap 160 may provide clearance between the button 120 and the housing 110 to allow for relative motion therebetween. In some examples, the gap 160 may be 2 millimeters or less.

The button 120 may include a flange 126. The flange 126 may be any shape, such as cylindrical, frustoconical, or any other shape, such as any of the shapes described above with respect to button surface 122. The flange 126 of the button 120 may have an upper flange surface 126*a* and a lateral flange surface 126*b*. The upper flange surface 126*a* may join with the lateral button surface 124 at an angle and the upper flange surface 126*a* may join with the lateral flange surface 126*b* by a chamfered edge 127.

A portion of the upper flange surface 126*a* may be formed at least partially in the shape of a ring. For example, the upper flange surface 126*a* may have an inner edge 126*a*1 that joins with the lateral button surface 124 at an angle, such as a substantially right angle, as shown in FIG. 2. The upper flange surface 126*a* may also include an outer edge 126*a*2 that may join with the lateral flange surface 126*b* by the chamfered edge 127 described above.

In one example, the outer edge 126*a*2 of the upper flange surface 126*a* may form at least a portion of an arc of a circle, as shown in FIG. 2. In this regard, the arc formed by the outer edge 126*a*2 may be interrupted, thereby forming less than a complete circle. A portion of the outer edge 126*a* may extend radially with respect to the inner edge 126*a*1, thereby forming a portion of a tab 128. In the same way, a portion of the lateral flange surface 126*b* may be formed at least partially in the shape of a cylinder, and in one example, the cylinder may be interrupted. A portion of the lateral flange surface 126*b* may extend radially with respect to the inner edge 126*a*1, thereby forming a portion of the tab 128. In some examples, the tab 128 may be integrally formed with respect to the button 120 or the flange 126. In other examples, the tab 128 may be a distinct member with respect to the flange 126.

The flange 126 may have a width. In the example where the flange is cylindrical, the width may be defined as a diameter with respect to the axis A. In other examples, such as where the flange 126 is another shape, the width may be any measurement between opposing surfaces of the flange 126.

In one example, the width of the outer edge 126*a*2 and/or the lateral flange surface 126*b* may be greater than a width of the lateral button surface 124. In the example where the lateral button surface 124 and flange 126 are at least partially cylindrical, a radius of the outer edge 126*a*2 and/or a radius of the lateral flange surface 126*b* may be larger than a radius of the lateral button surface 124. In this regard, a portion of the flange 126 may extend beyond a width of the lateral button surface 124.

The button 120 may also include a member 129. The member 129 may experience vertical displacement when the button surface 122 is pressed or otherwise activated by a user. Such vertical displacement may cause the member 129 to contact the contact 140, thereby allowing an input corresponding to the pressing or activation of the button to be registered by the device 100.

The button 120 may be formed of any material, such as polymer including a thermoplastic resin, etc. The button 120 may be formed of a material that may deform upon application of force thereto. The button 120 may be any size, depending on the device 100, and in some examples the button surface may have a diameter of up to 2 centimeters.

Figure 3:
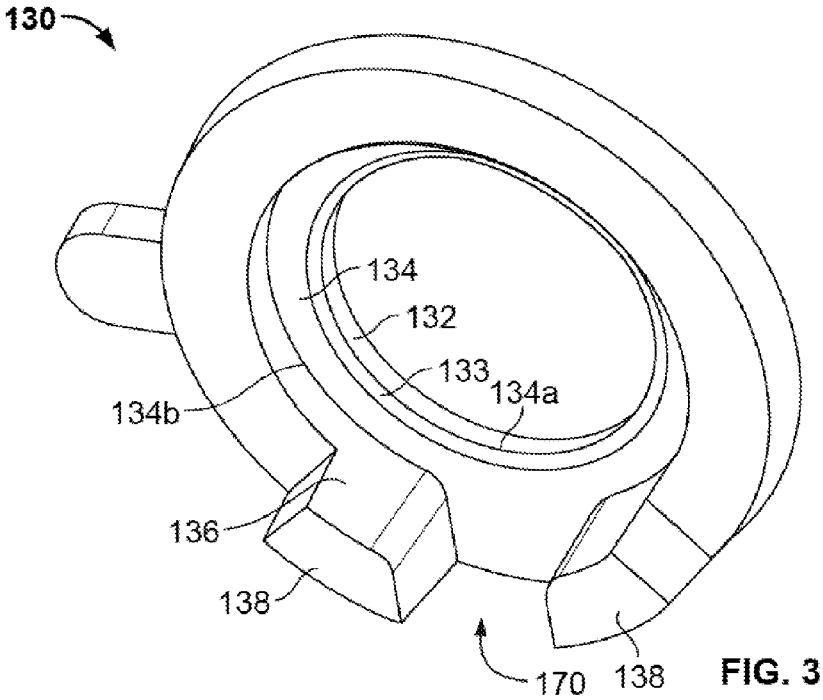
FIG. 3 is a perspective view of a seal for a button.

FIG. 3 is a bottom perspective view of a seal 130 of the device 100. The seal 130 may be formed of any material, such as a polymer or the like. The seal 130 may also be deformable to ensure a secure seal with respect to the button 120.

The seal 130 may include a first sealing surface 132. The first sealing surface 132 may be at least partially or completely cylindrical. In some examples, the first sealing surface 132 may have a shape that corresponds to the lateral button surface 124. A portion of the first sealing surface 132 may press and seal against a portion of the lateral button surface 124. In one example, the first sealing surface 132 may traverse the entire circumference of the lateral button surface 124.

The seal 130 may include a second sealing surface 134. A portion of the second seal surface 134 may press and seal against an upper flange surface 126*a*. In this regard, the second sealing surface 134 may at least partially ring-shaped. In some examples, at least a portion of the second sealing surface 134 may be substantially coplanar with respect to a portion of the upper flange surface 126*a* and/or the button surface 122.

The first and second sealing surfaces 132, 134 may join each other at a chamfered edge 133. The chamfered edge 133, as well as the chamfered edge 127 described above, may ensure a snug, secure fit of the seal 130 with respect to the button 120 without yielding any of the sealing effects provided by the seal 130.

A portion of the second sealing surface 134 may be defined by an inner edge 134*a* and an outer edge 134*b*. The inner edge 134*a* may be adjacent to the chamfered edge 133 and may be substantially circular. The outer edge 134*b* may form at least a portion of an arc of a circle, but may be interrupted. In this regard, one or more portions of the outer edge 134*b* may extend radially with respect to the inner edge 134*a*. A recess 170 may be defined between opposing portions of the radially formed outer edge. The opposing portions of the radially formed outer edge may also partially define a pair of protrusions 138 that may extend in a direction perpendicular to the second sealing surface 134. The protrusions 138 may also be defined in part by a third sealing surface 136.

The seal 130 may include a third sealing surface 136, as described above. A portion of the third sealing surface 136 may be cylindrical or frustoconical and may be positioned lateral to the button surface 122 and the lateral button surface 124, with respect to an axis perpendicular to and passing through the button surface 122. The axis, for example, may be centrally located with respect to the button surface 122. A portion of the third sealing surface 136 may press and seal against the lateral flange surface 126*b*. A portion of the third sealing surface 136 may be interrupted by the recess 170 such that a portion of the third sealing surface 136 may extend radially with respect to the inner edge 134*a*.

Figure 4A:
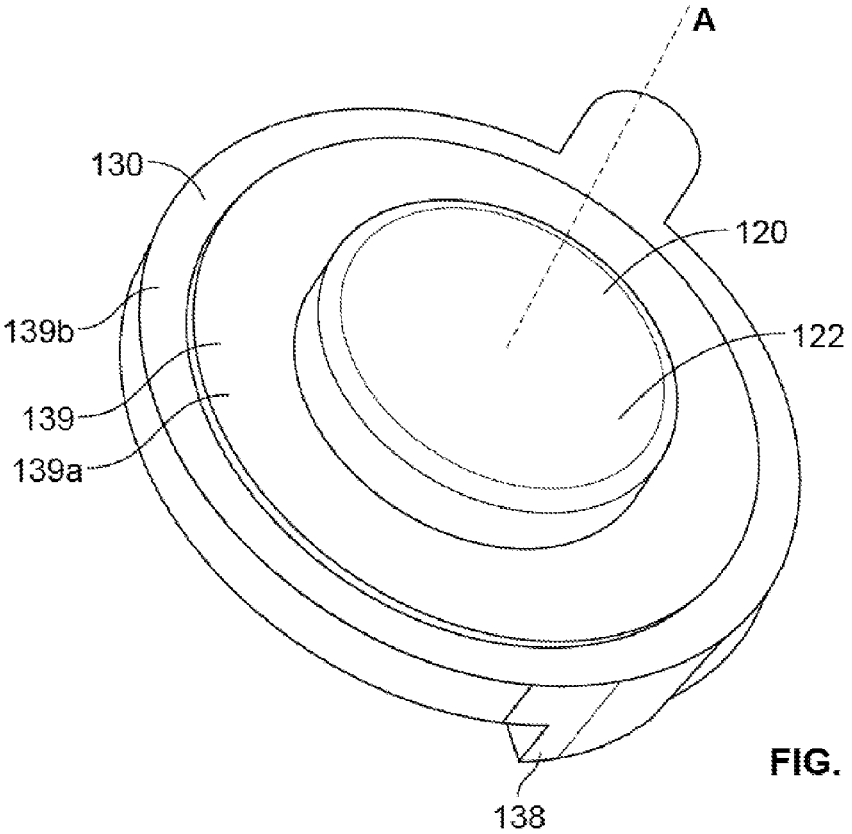
FIGS. 4A and 4B are perspective views of a button assembly.
Figure 4B:
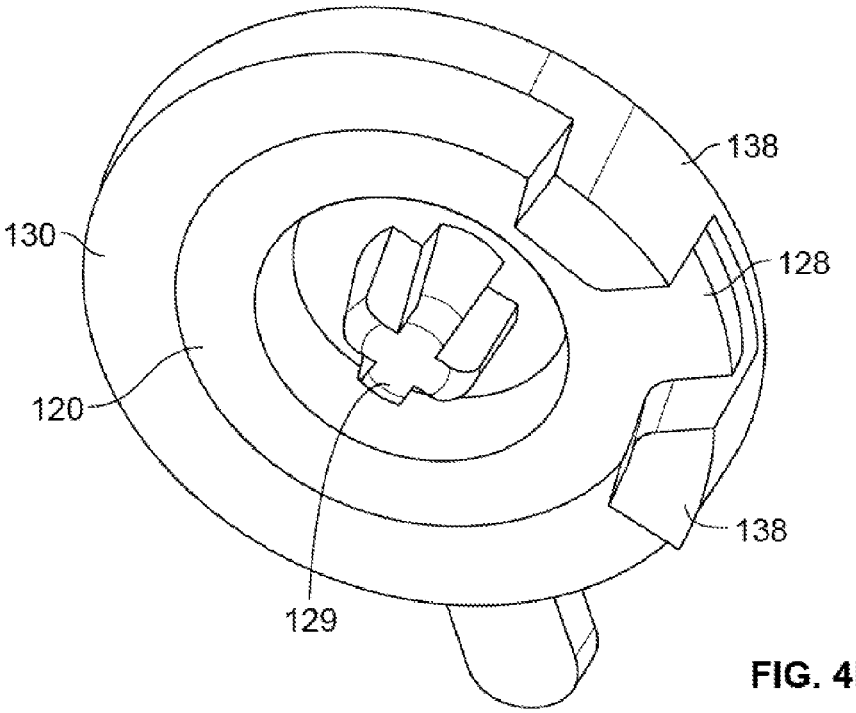

The seal 130 may also include an upper seal surface 139, as shown in FIG. 4A. FIGS. 4A and 4B are perspective views of a button assembly including a button and a seal assembled with one another. The upper seal surface 139 may be positioned adjacent to the inner housing surface of the housing 110. In some examples, the upper seal surface 139 may include a first upper seal surface 139*a* and a second upper seal surface 139*b*. The upper seal surfaces 139*a,b* may be on different planes with respect to another and may join at a stepped portion therebetween. In this regard, each of the upper seal surfaces 139*a, b* may each press and seal against respective portions of the inner housing surface 112*b*.

As shown, the button 120 and seal 130 may fit together as described above. For example, the button 120 may fit within a space defined by the sealing surfaces 132, 134, and 136 of the seal 130. In doing so, the tab 128 of the button may fit in the recess 170 defined between the two protrusions of the seal 130. In this regard, when the tab 128 is engaged with the projections of the seal 130, the button will be properly aligned with respect to the seal. Further, the tab 128 may seal against the portion of the second sealing surface 134 and the portion of the third sealing surface 136 that define a portion of the protrusions 138.

One of the advantages of the above disclosure is its ability to accommodate a wide variety of alternatives and additions to the foregoing features. As these and other variations and combinations of the features discussed above can be utilized without departing from the invention as defined by the claims, the foregoing description of the embodiments should be taken by way of illustration rather than by way of limitation of the invention as defined by the claims. It will also be understood that the provision of examples of the invention (as well as clauses phrased as "such as," "e.g.", "including" and the like) should not be interpreted as limiting the invention to the specific examples; rather, the examples are intended to illustrate only some of many possible aspects.

The invention claimed is:

1. A device, comprising:

a housing;

a button disposed at least partially within the housing, the button comprising:

a button surface;

a lateral button surface having a width;

a flange comprising an upper flange surface and a lateral flange surface, the lateral flange surface having a width greater than the width of the lateral button surface; and a tab, the tab being an extension of the flange and continuously extending outward from the upper flange surface; and a seal disposed at least partially within the housing, the seal comprising:

a plurality of protrusions which define a recess adapted to receive the tab;

a first sealing surface, a portion of which contacts the lateral button surface;

a second sealing surface, a portion of which contacts the upper flange surface; and a third sealing surface, a portion of which contacts the lateral flange surface, at least a portion of the third sealing surface defining a surface of the protrusions, wherein the tab contacts the portion of the third sealing surface.

2. The device of claim 1, wherein the upper flange surface and the lateral flange surface join by a chamfered edge.

3. The device of claim 1, wherein the first sealing surface and the second sealing surface join by a chamfered edge.

4. The device of claim 1, wherein a portion of the second sealing surface is substantially coplanar with a portion of the upper flange surface.

5. The device of claim 1, wherein the seal further comprises an upper sealing surface that contacts a portion of the housing.

6. The device of claim 5, wherein the upper sealing surface includes a first upper sealing surface and a second upper sealing surface, the second upper sealing surface being arranged at a different height with respect to the first upper sealing surface.

7. The device of claim 1, wherein the button surface extends beyond the housing.

8. The device of claim 1, wherein the lateral button surface is substantially cylindrical and the width of the lateral button surface is a radius, and wherein the lateral flange surface forms a portion of an arc of a circle and the width of the lateral flange surface is a radius.

9. The device of claim 1, wherein the seal further comprises an outermost perimeter and an opening to the recess in an outermost perimeter.

10. The device of claim 1, wherein the button further comprises a lower flange surface opposed to the upper flange surface, the lateral flange surface extending therebetween, and wherein a surface of the tab is substantially coplanar with the upper flange surface.

11. A button assembly, comprising:

a button comprising:

a button surface;

a lateral button surface having a radius;

a flange comprising an upper flange surface and a lateral flange surface, the lateral flange surface having a width greater than the width of the lateral button surface; and a tab, the tab being an extension of the flange and continuously extending outward from the upper flange surface; and a seal comprising:

a plurality of protrusions which define a recess adapted to receive the tab;

a first sealing surface, a portion of which contacts the lateral button surface;

a second sealing surface, a portion of which contacts the upper flange surface; and a third sealing surface, a portion of which contacts the lateral flange surface, at least a portion of the third sealing surface defining a surface of the protrusions, wherein the tab contacts the portion of the third sealing surface.

12. The assembly of claim 11, wherein the upper flange surface and the lateral flange surface join by a chamfered edge.

13. The assembly of claim 11, wherein the first sealing surface and the second sealing surface join by a chamfered edge.

14. The assembly of claim 11, wherein a portion of the second sealing surface is substantially coplanar with a portion of the upper flange surface.

15. The assembly of claim 11, wherein the seal further comprises an upper sealing surface which contacts a portion of the housing, the upper sealing surface further including a first upper sealing surface and a second upper sealing surface, the second upper sealing surface being arranged at a different height with respect to the first upper sealing surface.

16. The assembly of claim 11, wherein the lateral button surface is substantially cylindrical and the width of the lateral button surface is a radius, and wherein the lateral flange surface forms a portion of an arc of a circle and the width of the lateral flange surface is a radius.

17. The button assembly of claim 11, wherein the seal further comprises an outermost perimeter and an opening to the recess in an outermost perimeter.

18. The button assembly of claim 11, wherein the button further comprises a lower flange surface opposed to the upper flange surface, the lateral flange surface extending therebetween, and wherein a surface of the tab is substantially coplanar with the upper flange surface.

19. A device, comprising:

a housing comprising an outer housing surface and an inner housing surface;

a button disposed at least partially within the housing, the button comprising:

a button surface;

a lateral button surface having a radius;

a flange comprising an upper flange surface and a lateral flange surface, the lateral flange surface having a width greater than the width of the lateral button surface; and a tab, the tab being an extension of the flange and continuously extending outward from the upper flange surface; and a seal disposed at least partially within the housing, the seal comprising:

a plurality of protrusions which define a recess adapted to receive the tab;

a first sealing surface, a portion of which contacts the lateral button surface;

a second sealing surface, a portion of which contacts the upper flange surface;

a third sealing surface, a portion of which contacts the lateral flange surface, at least a portion of the third sealing surface defining a portion of the protrusions; and an upper sealing surface, a portion of which contacts the inner housing surface, wherein the tab contacts the portion of the third sealing surface.

20. The device of claim 19, wherein the upper sealing surface includes a first upper sealing surface and a second upper sealing surface, the second upper sealing surface being arranged at a different height with respect to the first upper sealing surface.

* * * * *